United States Patent [19]

Barrington

[11] Patent Number: 4,928,520

[45] Date of Patent: May 29, 1990

[54] PLUG RELEASE INDICATOR

[75] Inventor: Burchus Q. Barrington, Duncan, Okla.

[73] Assignee: Halliburton Company, Duncan, Okla.

[21] Appl. No.: 433,398

[22] Filed: Nov. 7, 1989

Related U.S. Application Data

[63] Continuation of Ser. No. 318,215, Mar. 2, 1989, abandoned.

[51] Int. Cl.[5] ..... E21B 33/00

[52] U.S. Cl. ..... 73/151; 166/70; 200/81.9 M

[58] Field of Search ..... 73/151; 166/64, 66, 166/70; 15/104.062; 324/207, 208, 226; 335/205; 200/61.41, 61.42, 81.9 R, 81.9 M

[56] References Cited

U.S. PATENT DOCUMENTS

| | | | |
|---|---|---|---|
| 2,201,311 | 5/1940 | Halliburton | 181/0.5 |
| 2,277,110 | 3/1942 | Johnson | 181/0.5 |
| 2,698,363 | 12/1954 | Rush | 200/61.41 |
| 2,769,929 | 11/1956 | Hardway, Jr. | 310/2 |
| 3,176,513 | 4/1965 | Kriete | 73/194 |
| 3,632,918 | 1/1972 | Anson et al. | 200/61.41 |
| 3,749,864 | 7/1973 | Tice | 200/81.9 M |
| 4,206,810 | 6/1980 | Blackman | 166/336 |
| 4,282,413 | 8/1981 | Simons et al. | 200/81.9 M |
| 4,427,065 | 1/1984 | Watson | 166/70 |
| 4,468,967 | 9/1984 | Carter, Jr. | 73/661 |
| 4,671,353 | 6/1987 | Daming | 166/70 |

*Primary Examiner*—Hezron E. Williams
*Assistant Examiner*—Kevin D. O'Shea
*Attorney, Agent, or Firm*—Mark E. McBurney; James R. Duzan

[57] ABSTRACT

A plug release indicator is provided which includes an elastomeric probe, with a wire embedded therein, which extends into the interior area of a plug housing or well casing. The wire has a lip at one end and an anchor at the other end, such that when a cementing plug contacts and deflects the probe, the lip moves thereby closing a micro-switch. The micro-switch closes an electrical indicating circuit including a power supply, indicator light, buzzer, or the like. In a second embodiment, a wire contacts the cementing plug and rotates a shaft containing a magnet therein. The magnet then activates a magnetic switch thereby closing the electrical indicating circuit. Another embodiment includes an electrically conductive surface embedded within an electrically insulating rotatable shaft. Upon rotation of the shaft, the conducting surface completes an electrical circiut through adjacent electrical contacts and the electrical indicating circuit is closed. Thus, the present invention indicates the precise instant when a cementing plug is released, or passes by the plug release indicator.

19 Claims, 2 Drawing Sheets

PLUG RELEASE INDICATOR

This application is a continuation of application Ser. No. 318,215, filed 3-2-89, abandoned.

BACKGROUND OF THE INVENTION

The present invention relates to an electro-mechanical plug release indicator system for use in well cementing operations.

In well cementing operations ensuring the positive release of the cementing plug is a serious problem. It is critical to the cementing operation for the operator to know when the plug releases so that the volume of cement being pumped downhole can be measured.

Typical prior art cementing plug containers utilize a mechanical lever actuated type plug release indicator to indicate the passage of the cementing plug from the cementing plug containers. In some instances, these prior art mechanical lever actuated type plug release indicators may indicate the passage of the cementing plug from the cementing plug container, although the cementing plug is still contained within the container. The failure to properly release the cementing plug from the cementing plug container can ruin an otherwise profitable well cementing job due to the over-displacement of the cement to insure an adequate amount of cement has been pumped into the annulus between the casing and wellbore.

Another type of cementing plug indicator utilizes a radioactive nail placed into the cementing plug in the cementing plug container. When the cementing plug having the radioactive nail lodged therein is no longer present in the cementing plug container, a radiation measuring instrument, such as a Geiger counter, will not react to the radiation emitted from the radioactive nail in the cementing plug thereby indicating that the plug is no longer in the cementing plug container. However, since the shelf life of readily available and easily handled radioactive nails is limited, such nails may be difficult to obtain and store, when working in remote areas.

Additionally, an accoustic type plug release indicator can be utilized in which a microphone detects the sound of the plug moving through the well casing and transmits the signal to an operator listening system and a magnetic tape recorder.

SUMMARY OF THE INVENTION

A first embodiment of the present invention includes a casing or plug container body with a downwardly oriented slot therein. An elastomeric probe which extends through the slot and into the plug container includes a wire embedded therein. The wire being attached to a micro-switch such that when a cementing plug deflects the elastomeric probe, the wire is extended thus closing the micro-switch. Therefore, an electrical circuit is made between the micro-switch, a power source and an electric indicator each time a plug deflects the elastomeric probe.

Another embodiment utilizes a biased wire which extends into the plug container slot. The wire is hinged and sealed upon a non-magnetic pivotable shaft. A magnetic contact is embedded into the pivotable shaft. As the cement plug moves through the container it forces the hinged wire to rotate 90 degrees such that the magnetic contact aligns with two electrical probes causing a Reed magnetic switch to close. Consequently, a circuit can be completed through the magnetic switch, a power source and an electrical indicator.

In each of the above embodiments, the system returns to its original state once the plug passes due to the elastic property of the probe, and the biasing of the wire.

Therefore, in accordance with the previous summary, objects, features and advantages of the present invention will become apparent to one skilled in the art from the subsequent description and the appended claims taken in conjuction with the accompanying drawings.

DETAILED DESCRIPTION OF THE PREFERRED EMBODIMENTS

Figure 1:
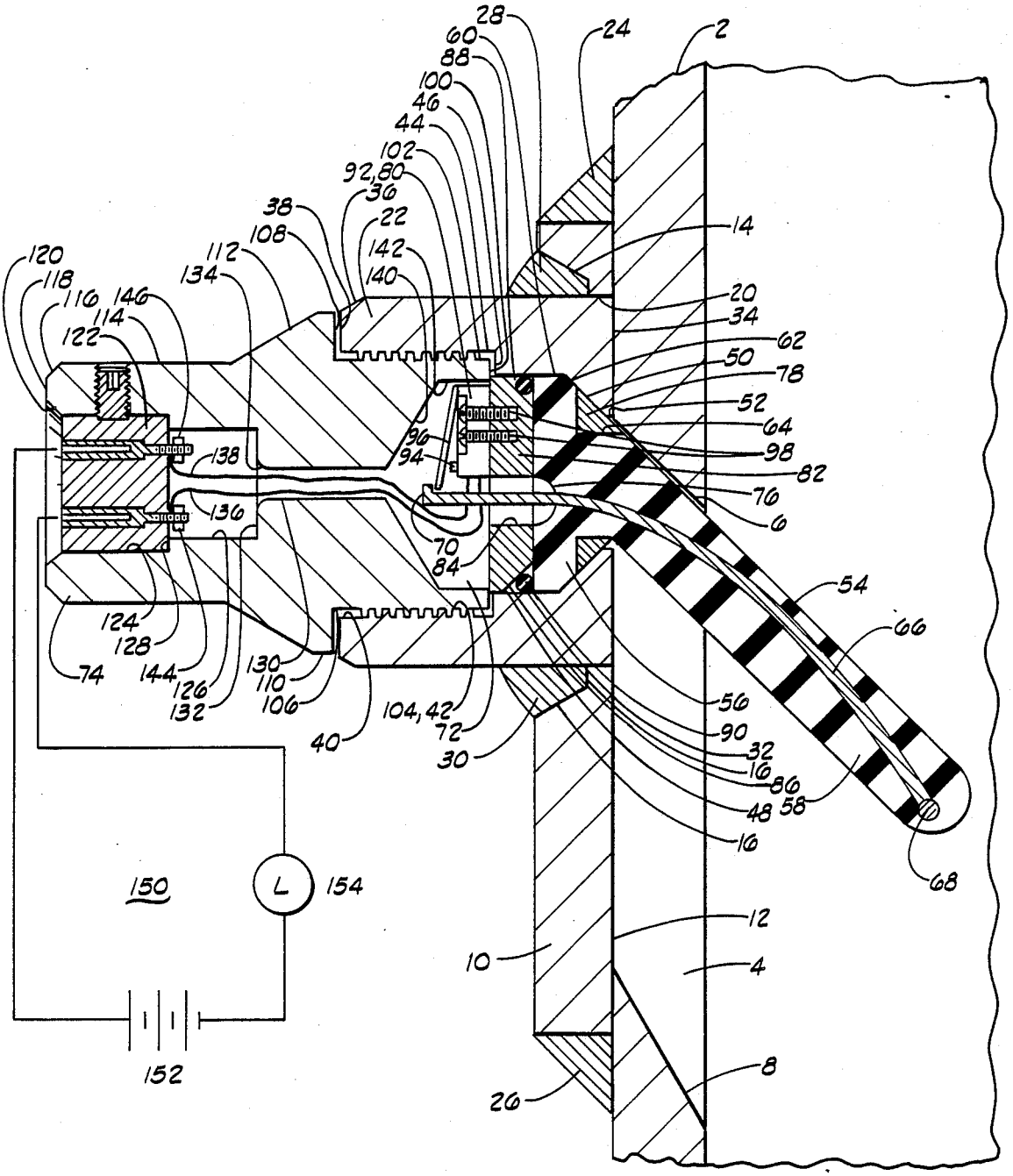
FIG. 1 is a cross-sectional elevational view showing a first embodiment of the plug release indicator of the present invention utilizing an elastomeric probe and a micro-switch.

Referring to FIG. 1, a crossection of a plug housing, or casing 2 is shown having a downwardly facing slot 4. Slot 4 is defined by tapered surfaces 6 and 8 on the top and bottom, respectively. Slot 4 is further defined along the outside thereof by a plate 10. The inside surface 12 of plate 10 substantially corresponds to the outside circumference of casing 2. Plate 10 includes a recessed area defined by tapered surfaces 14, 16 and recessed surfaces 10. A circular hole 20 is defined within recessed surface 10 which allows probe housing 22 to abut the outside circumference of casing 7. Plate 10 is affixed to the outside of casing 2 by any conventional means such as welding or the like, as shown by welds 24, 26. Similarly, probe housing 22 is conventionally affixed to plate 10 by welding, or the like, as shown by welds 28, 30.

Still referring to FIG. 1, probe housing 22 will now be described. Housing 22 includes a substantially cylindrical outer surface 32 having a base 34 abutting the outer surface of casing 2. Outer surface 32 intersects frusto-conical surface 36. Upper end 38 is a substantially circular surface oriented parallel to base 34 and intersecting frusto-conical surface 36.

First inside cylindrical surface 40 intersects upper end 38 opposite to frusto-conical outer surface 36. Probe housing 22 also includes inner threaded surface 42 disposed between first inside surface 40 and a second inside cylindrical surface 44. Outwardly facing annular shoulder 46 connects second surface 44 with a third inside cylindrical surface 48, which then intersects inside frusto-conical surface 50. Finally, frusto-conical surface 50 intersects fourth inside cylindrical surface 52, which in turn intersects base 34.

Probe means 54 is insertable into housing 22 and includes a base portion 56 and probe extension member 58. Probe means 54 is fabricated from any suitable resilient elastomeric material, such as rubber or plastic. Base portion 56 is generally cylindrical, or disc like in shape and includes an outside cylindrical surface 60 and frusto-conical outer surface 62, each having an outside circumference substantially corresponding to the inside circumference of third cylindrical surface 48 and inside frusto-conical surface 50, respectively.

Probe extension 58 initially extends at a 90 degree angle from base 56 and includes a cylindrical outer surface 64 which defines cylindrically shaped probe extension 58. Extension 58 is then angled downwardly at approximately a 45 degree angle from vertical, extending through slot 4 and into the interior of casing 2. The exterior of the angled portion of probe extension 58 in the preferred embodiment has a circular crosection, however many other crossectional configurations, such as a rectangle, hexagon, or other polygon may be used.

Probe means 54 is molded around an eccentric wire 66 which includes an anchor 68 disposed in the distal end of extension 58. Further, a lip 70 is affixed to an end of wire 66 opposite anchor 68 and extends into the volume 72 defined by switch housing 74 (described below). Wire 66 is longitudinally moveable within probe means 54 such that downward motion of probe extension 58 causes lip 70 to be pulled, or displaced in a direction towards casing 2. As can be seen, anchor 68 provides a stable reference point 50 such that wire 66 will not be pulled out of probe means 54 upon deflection thereof. Further, base 56 includes a semi-spherical surface 76 which reduces any friction resistance experienced by wire 66, as it moves relative to base 56. Next, a A metal collar 78, configured to correspond to the volume defined by frusto-conical surface 50, cylindrical outer surface 65 and base 56, provides a metal to metal seal between probe housing 22 and resilient probe means 54. Also, collar 78 provides support to probe means 54 enabling the orientation of base 56 to remain constant even during periods of deflection of extension 58.

Mirco-switch 80 includes a base portion 82 having a cylindrical hole 84 defined therein which allows wire 66 to extend therethrough. Base 82 is of a generally disc-like configuration, but includes an outer frusto-conical surface 86, which in conjuction with cylindrical surface 48 and probe base 56 defines a seal area 88 in which a seal, such as an elastomeric O-ring 90, or the like is placed. Thus, a fluid tight seal is created between micro-switch base 2 and probe housing 22.

Micro-switch 80, further includes contact base 92 having a contact 94 and contact arm 96, mounted thereon. Contact base 92 is in turn mountable on to base portion 82 by conventional means such as threaded screws 98, or the like.

Therefore, it can readily be seen how the deflection of probe extension 58, due to the passing of a cementing plug (not shown) through casing 2 will cause lip 70 to move towards casing 2 thus contacting arm 96, which in turn contacts the contact point 94, thereby closing an electrical circuit.

It should be noted that upon placement of micro-switch 80 and probe means 54, as shown in FIG. 1, proper alignment of lip 70 with respect to arm 94 will occur. It can also be seen how probe extension 58 substantially corresponds in size to slot 4 so that upon deflection, extension 58 moves into slot 4, allowing the cementing plug to pass.

Switch housing 74 includes an annular edge 100 which abuts micro-switch base portion 82, thereby providing support thereto. Switch housing 74 further includes first outer cylindrical surface 102, outer threaded surface 104 and second cylindrical outer surface 106. Threaded surface 104 is engagable with threaded surface 42 of probe housing 27. Annular shoulder 108 faces in a direction towards casing 2 and will abut upper end 38 when housing 74 is fully engaged. Also, it can be seen how the engagement of switch housing 74 with probe housing 22, deforms O-ring 90 thus forming the above noted fluid tight seal. Switch housing 74 also includes third outer cylindrical surface 110, first outer frusto-conical surface 112, fourth outer cylindrical surface 114, second frusto-conical outer surface 116 and outer end 118. First inner frusto-conical surface 120, terminal block 122 can be easily inserted into switch housing 74.

Inner cylindrical surface 124 receives and substantially corresponds to the outer circumference of block 122. Second inner cylindrical surface 126 has a diameter less than surface 124, thereby forming annular shoulder 128 which acts as a stop to restrict the inward movement of block 122. Similarly circular passageway 130 and surface 126 form second annular shoulder 132 including rounded edge 134 for reducing any damage which might occur to the insulation of wires 136, 138 if a sharp edge was present.

Second inner frusto-conical surface 140, third inner cylindrical surface 142 and switch base 82 define volume 72 which encompasses micro-switch 80. As can readily be seen, wires 136, 138 connect switch 80 to terminal block 122 via passageway 130. Connections 144, 146, such as are known in the art, electrically connect switch 80 to external indicating means 150 which may include battery 152 and indicating light 154. However, other configurations of indicating means 150 would be readily apparent to one skilled in the art, such configurations may include an AC power source, buzzer or meter indicator.

Thus from the above description it can be seen how upon passage of a cementing plug, wire 66 is deflected thereby closing micro-switch 80 which forms an electrical circuit and allowing power to be supplied to indicator 154 by power source 152.

A second preferred embodiment will now be described with reference to FIG. 2 which is a plan view of another plug release indicator configuration. A plug housing or casing 2' is shown which includes a cut out portion 155 having cylindrical surface 156, outwardly facing annular shoulder 158 and frusto-conical surface 160.

Indicator housing 22' is insertable into cut-out portion 155 and rigidly affixed thereto by welds 162, 164, or other conventional means. A tapered surface 166 adjoins the interior surface 168 of casing 2' and a first outer cylindrical surface 170 is disposed adjacent surface 156.

Inwardly facing annular shoulder 172 abuts annular shoulder 158 when housing 22' is fully inserted into cut-out 155. Indicator housing 22' further includes second cylindrical outer surface 174, outer frusto-conical surface 176 and outside edge 178. A first inside cylindrical surface 180, threaded surface 182, second inside cylindrical surface 184 and first outwardly facing annular shoulder 186 are also provided. Third inside cylindrical surface 188 and fourth inside cylindrical surface 190 intersect to form second outwardly facing annular shoulder 192.

Switch housing 74' is insertable into indicator housing 22' and includes outer edge 194, first outer frusto-conical surface 196, first outer cylindrical surface 198, second frusto-conical outer surface 200, second cylindrical outer surface 201, outer threaded surface 202, third outer cylindrical surface 204, seal recessed area 206, original 207 and inwardly facing annular shoulder 210. The distance that switch housing 74' can be inserted into indicator housing 22' is limited by contact of inward shoulder 210 with outward shoulder 192.

A spring loaded wire 208 is affixed at each end into switch housing 74' by insertion into two cylindrically configured holes 212, 214, or the like.

A fourth outer cylindrical surface 216, third outer frusto-conical surface 218 and inside edge 220 are also included in switch housing 74'.

The interior configuration of housing 74' includes first inside cylindrical surface 222, inside threaded surface 223, first outward annular shoulder 221, second inside cylindrical surface 224, cylindrical inner chamber 225 and cylindrical probe chamber 226, which intersect to form second outward annular shoulder 227. Additionally, a cylindrical channel 229 is provided which communicates probe chamber 226 with cut out area 155 and includes a tapered surface 230 and cylindrical surface 231.

Next, a switch insert 232 is provided which includes an outside edge 233, outside threaded surface 234, inward annular shoulder 235 and a cylindrical outer surface 236. A cylindrical switch chamber 238 is provided and ports 239 and 240 are included which allow communication from chamber 238 to probe chamber 226 and to the outside, respectively.

A magnetically activated switch 241, such as a reed-type magnetic switch or the like is housed in chamber 238 between two rubber cushions 242, 243. Cushions 242, 243 can be made of any suitable resilient elastomeric material and each include a hole defined therein which allow connection wires 244, 245 and rigid magnetic conductors 246, 247 to be connected to switch 241. Electronic probes 248, 249 are embedded in a housing 250 and disposed within probe chamber 226. A spring 251 biases probes 248, 249 towards a pivotable shaft 252 which is inserted and rotatable within a second cylindrical channel 253 disposed through the inward end of switch housing 72' and parallel channel 229. Once the probes 248, 249 are biased against shaft 252, retaining means such as a clip insert 254, which is affixed to an end of wire 208 and resiliently held thereby, is inserted into channel 226 and contacts housing 250. Thus, clip insert 254, in conjunction with spring 251 holds probes 248, 249 in the biased position. Furthermore, wire 208 includes a coil, or spring loop, 255, 256 affixed to each end which provide resiliency thereto.

Rotatable shaft 252 includes slots 260, 261 at each end thereof which receive wire 208. O-ring recesses 257 including O-rings 258 are disposed at each end of shaft 252 to provide a sealing engagement between housing 74' and shaft 252. Although two O-rings 258 are shown in each recess 257 it should be noted that many sealing configurations are possible. Shaft 252 is fabricated from a non-magnetic material and further includes a magnetic contact 259 embedded therein.

The operation of the plug release indicator depicted in FIG. 2 will now be described. As a cementing plug (not shown) is pumped through casing 2' it contacts wire 208, thus deforming it due to the resiliency provided by coils 255, 256. The movement of wire 208 is transferred to shaft 252, through slots 260, 261, providing rotational movement thereto. Shaft 252 rotates approximately 90 degrees thus aligning magnetic contact 259 with the electronic probes 248, 249 of switch 241. The alignment and proximity of the magnetic field to probes 248, 249 causes contacts 263, 264 to close, thereby creating an electrical circuit between indicator means 150', which is identical to means 150 discussed in conjunction with the first embodiment.

After the cementing plug (not shown) passes clear of wire 208, it resiliently returns to the initial position and awaits the passage of any additional plugs.

Figure 2:
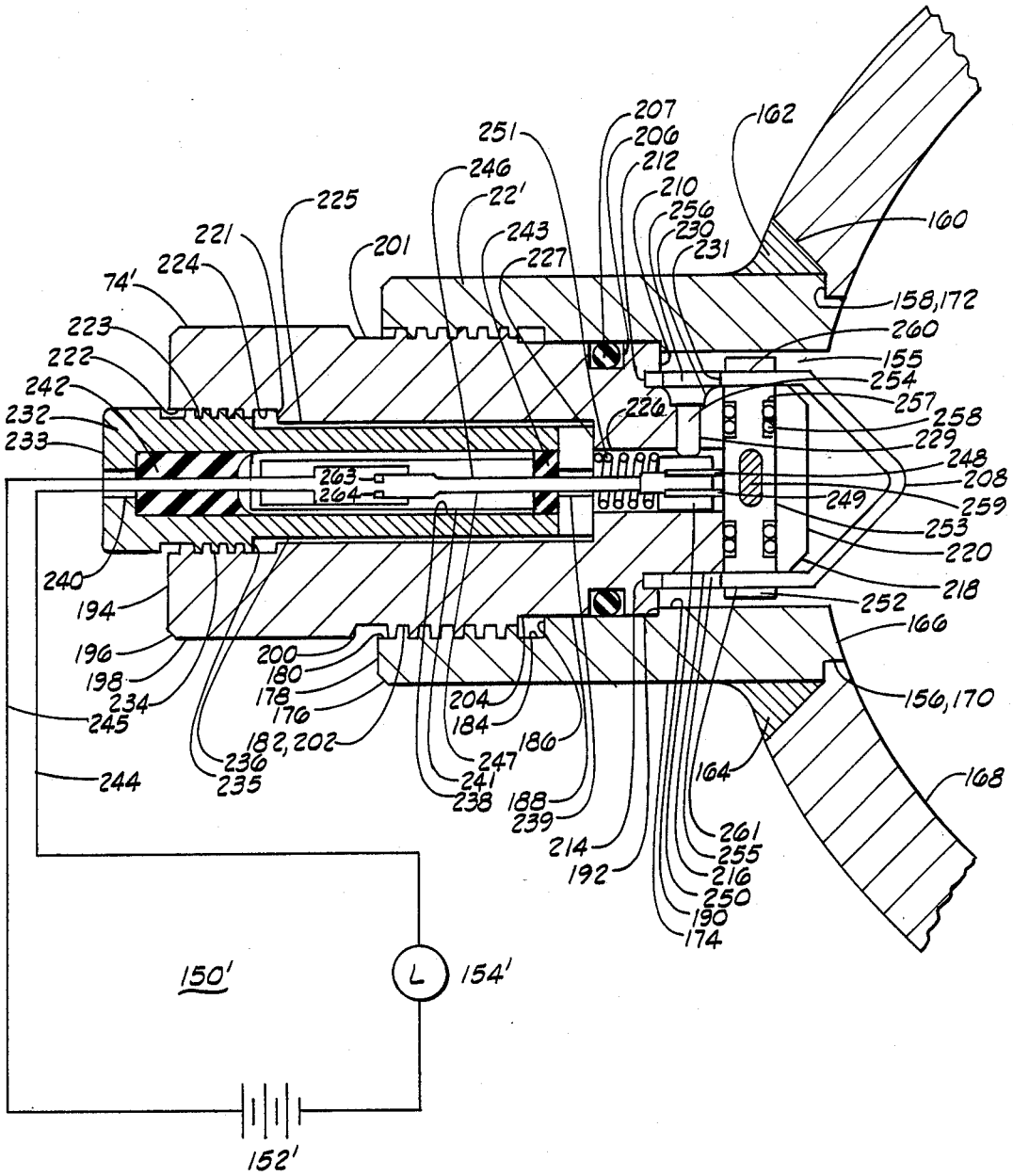
FIG. 2 is a plan view illustrating a second embodiment of the present invention which uses a biased wire in conjunction with a Reed magnetic switch.

It should be noted that many other embodiments are possible using the configuration of FIG. 2. For example, shaft 252 could be constructed from an insulating material and magnet 229 replaced with an electrically conductive material, such as copper. Magnetic switch 241 and probes 248, 249 could then be replaced with conventional electrical contacts, directly connected to wires 244, 245 and indicating means 150'. Thus, as a cementing plug passes and causes shaft 252 to rotate, an electrical circuit would be made through the conventional electrical contacts, electrically conductive material, wires 244, 245 and indicating means 150'. Thus indicator light 154', or other indicating means, would be energized from power source 152' and the precise time when the cementing plug is released can be determined.

Other objects, features, adaptions and advantages of the present invention will be readily apparent to one skilled in the art in which the invention pertains from a reading of the foregoing. It is accordingly intended that the foregoing description be illustrative only and that the scope of the invention be limited only by the language, with a full range of equivalents, of the appended claims.

What is claimed is:

1. A plug release indicator for determining when a cementing plug passes a predetermined point, said indicator comprising:

a casing having a slotted portion defined therethrough;

switch means, disposed proximate said casing, for closing an electrical circuit;

resilient probe means, extending through said slotted portion and into the interior of said casing, for contacting said cementing plug;

a wire embedded within said probe means, said wire having a lip formed on an end thereof extending from said probe, said lip actuating said switch means upon passage of said cementing plug; and indicating means electrically connectable to said switch means, for indicating the passage of said cementing plug.

2. An indicator according to claim 1, further comprising:

a plate having a hole defined therethrough, said plate being affixed to said casing proximate said slotted portion;

a probe housing insertable into the hole defined within said plate and affixed to said plate, said probe housing supporting and encasing on end of said probe, said housing further including a cavity defined by an inner threaded surface;

a switch housing for enclosing said switch means, said switch housing having an outer threaded surface engagable with said probe housing threaded surface, said switch housing further including a cavity defined therein; and terminal block means, insertable into said cavity, for providing an electrical connection between said switch means and said indicator means.

3. An indicator according to claim 2 wherein said probe is comprised of an elastromeric material.

4. An indicator according to claim 2 wherein said probe comprises:

a base portion having a substantially cylindrical configuration;

a neck portion having a substantially cylindrical configuration of a diameter less than said base portion and extending perpendicularly therefrom;

a body portion extending angularly away from the direction in which said plug is approaching, said body portion extending into the interior of said casing; and an anchor embedded in the end of said body portion opposite said neck portion, such that as said plug contacts and deflects deflects said probe, the movement of said anchor pulls said wire, thereby causing said lip to contact said switch means.

5. An indicator according to claim 4 wherein said switch means comprises:

a base portion a pivotable contact arm, affixed at one end to said base portion; and a stationary contact, affixed to said base portion proximate the other end of said contact arm, said lip portion engaging said other end of said contact arm upon movement of said wire embedded within said probe, thereby causing said contact arm to abut said stationary contact.

6. An indicator according to claim 5 wherein said indicating means comprises:

an electrical power source, operatively connectable to said switch means; and an electrically operated indicating lamp being operatively connectable to said power source such that said power source energizes said indicating lamp upon said contact arm abutting said stationary contact.

7. A plug release indicator for determining when a cementing plug passes a predetermined point, said indicator comprising:

a casing having a substantially circular hole defined therethrough;

contact means, extending through said circular hole and into an interior of said casing, for contacting said cementing plug upon the passage thereof;

a rotatable shaft having a magnet disposed therein, said shaft pivoting in response to the passage of said cementing plug;

magnetic switch means, disposed adjacent said rotatable shaft, for closing a pair of electrical contacts in response to the rotation of said magnet; and indicating means, electrically connectable to said magnetic switch means, for indicating the passage of said cementing plug.

8. An indicator according to claim 7, further comprising:

an indicator housing, including a cavity defined by an inner threaded surface and an inner cylindrical surface, said indicator housing being affixed to said casing such that said cavity is in communication with the interior of said casing via said circular hole;

a switch housing, having an exterior threaded surface engageable with said indicator housing inner threaded surface, said switch housing including a cavity defined by an inner threaded surface, first cylindrical inner surface and, a second cylindrical inner surface having a diameter less than said first cylindrical surface; and a switch insert having an exterior threaded surface engageable with said switch housing inner threaded surface and including a chamber defined by a cylindrical surface.

9. An indicator according to claim 8 wherein said indicator housing is substantially cylindrically configured, and said inner threaded surface is disposed on an end of said switch housing opposite said casing.

10. An indicator according to claim 9 wherein said switch housing, further comprises:

a first portion, disposed nearest said casing having a first channel, for receiving said rotatable shaft therethrough, extending perpendicular to the axis of said switch housing, said first portion also having a second channel, parallel to said first channel and in communication with said cavity and intersecting said second cylindrical surface;

a second portion, adjacent said first portion on a side opposite said casing, including said exterior threaded surface and an annular recessed area for receiving an elastomeric seal such that fluid tight sealing engagement is provided between said indicator housing and said switch housing; and a third portion, adjacent said second portion on a side opposite said first portion, said third portion extending from said indicator housing when said switch housing is engaged therewith and includes said switch housing inner threaded surface.

11. An indicator according to claim 10, wherein said switch insert includes a first port and a second port, both in communication with said switch insert chamber cavity, said first port being in an end of said switch insert nearest said casing and said second part being in the opposite end of said switch

12. An indicator according to claim 7 wherein said contact means comprises:

a bent resilient wire extending into the interior of said casing and affixed at a first end and second end to said switch housing;

tension means, affixed adjacent said first and second ends, for providing resiliency to said wire;

a first and second slot, defined in a first and second end of said rotatable shaft, respectively, for receiving said wire;

sealing means for providing sealing engagement between said rotatable shaft and said switch housing; and retaining means for holding said magnetic switch means proximate said magnet embedded within said rotatable shaft.

13. An indicator according to claim 12 wherein said magnetic switch means comprises:

probe means for contacting said magnetic upon rotation of said shaft, and for detecting a magnetic field associated with said magnet;

biasing means for biasing said probe means in a direction towards said rotatable shaft; and electrical contacts for making an electrical connection upon contact of said probe means with said magnet.

14. An indicator according to claim 13 wherein said electical contacts are disposed within said switch insert chamber and at least one cushion is disposed adjacent said contacts for providing protection thereto.

15. An indicator according to claim 14 wherein said probe means is magnetically connected to said electrical contacts via said first port, and said electrical contacts being electrically connected to said indicating means via said second port.

16. An indicator according to claim 15 wherein said indicating means comprises:

an electrical power source, operatively connectable to said magnetic switch means; and an electrically operated indicating lamp being operatively connectable to said power supply and said electrical contacts, such that said power supply energizes said indicating lamp upon rotation of said magnet proximate said probe means and closure of said electrical contacts.

17. A plug release indicator for determining when a cementing plug passes a predetermined point, said indicator comprising:

a casing having a substantially circular hole defined therethrough;

contact means, extending through said circular hole and into the interior of said casing, for contacting said cementing plug upon the passage thereof;

a rotatable shaft, constructed from a non-magnetic material, said shaft including a magnetic contact member embedded therein and pivoting in response to the passage of said cementing plug;

switch means, disposed adjacent said magnetic contact member within said rotatable shaft, for closing an electrical circuit in response to the rotation of said shaft; and indicating means, electrically connectable to said switch means for indicating the passage of said cementing plug.

18. An indicator according to claim 17 wherein said switch means comprises electrical contacts and electronic probes which make an electrical connection upon rotation of said shaft such that said electronic probes abut said magnetic contact member of said rotatable shaft.

19. An indicator according to claim 18 wherein said indicating means comprises:

an electrical power source, operatively connectable to said switch means; and an electrically operated indicating lamp being operatively connectable to said power source and said switch means, such that said power source energizes said indicating lamp upon rotation of said electrically conductive surface.

* * * * *

UNITED STATES PATENT AND TRADEMARK OFFICE

CERTIFICATE OF CORRECTION

PATENT NO. : 4,928,520

DATED : May 29, 1990

INVENTOR(S) : Burchus Q. Barrington

It is certified that error appears in the above-indentified patent and that said Letters Patent is hereby corrected as shown below:

In Column 8, line 31, after the word "switch", insert the word --insert.--.

Signed and Sealed this

Twenty-first Day of June, 1994

*Attest:*

Bruce Lehman

BRUCE LEHMAN

*Attesting Officer*

*Commissioner of Patents and Trademarks*